US007686893B2

(12) United States Patent
Robinson

(10) Patent No.: US 7,686,893 B2
(45) Date of Patent: Mar. 30, 2010

(54) WASHER FOR TANKS

(75) Inventor: Michael Robinson, Abington, PA (US)

(73) Assignee: Sun HydroCorps Company, LLC, Glenmoore, PA (US)

( * ) Notice: Subject to any disclaimer, the term of this patent is extended or adjusted under 35 U.S.C. 154(b) by 1663 days.

(21) Appl. No.: 10/499,386

(22) PCT Filed: Jan. 9, 2003

(86) PCT No.: PCT/US03/00653

§ 371 (c)(1),
(2), (4) Date: Jun. 16, 2004

(87) PCT Pub. No.: WO03/059541

PCT Pub. Date: Jul. 24, 2003

(65) Prior Publication Data

US 2005/0005955 A1 Jan. 13, 2005

(51) Int. Cl.
*B08B 9/093* (2006.01)

(52) U.S. Cl. ..... 134/168 R; 134/146; 74/89; 74/89.25

(58) Field of Classification Search ..... 134/168 R, 134/146; 74/89, 89.25
See application file for complete search history.

(56) References Cited

U.S. PATENT DOCUMENTS 2,784,034 A * 3/1957 Metcalf ..... 239/227
3,696,825 A * 10/1972 Guignon et al. ..... 134/167 R
4,056,227 A * 11/1977 Fismen ..... 239/227
4,214,705 A * 7/1980 Watts et al.
4,635,830 A * 1/1987 Wehr et al. ..... 222/334
4,779,797 A * 10/1988 Robinson
5,056,716 A * 10/1991 Robinson
5,720,310 A * 2/1998 Moulder
2002/0000224 A1 * 1/2002 Tscherne et al. ..... 123/572

FOREIGN PATENT DOCUMENTS

| | | | |
|---|---|---|---|
| EP | 172689 | * | 2/1986 |
| GB | 2262316 | * | 6/1993 |
| GB | 2372951 | * | 9/2002 |
| WO | WO 96/37315 | * | 11/1996 |

* cited by examiner

*Primary Examiner*—Michael Cleveland
*Assistant Examiner*—Samuel A Waldbaum
(74) *Attorney, Agent, or Firm*—Stuart E. Beck

(57) ABSTRACT

A tank washer comprising a housing which supports reciprocating spray nozzles for spaying the walls of a tank which is to be cleaned with a cleaning liquid. The reciprocation of the spray nozzles is controlled by a piston that reciprocates in the housing under the force of the cleaning liquid. A piston assembly for use in a tank washer comprising a piston head and a connecting rod having one end connected to said piston head. The piston is mounted in a piston chamber for reciprocation.

15 Claims, 3 Drawing Sheets

WASHER FOR TANKS

FIELD OF THE INVENTION

This invention relates to a washer for tanks and more particularly to a washer for tanks of the type that may be used for containing liquids, food products, industrial liquids or the like and which require cleaning from time to time to remove deposits left by the materials or to ready the tank to receive a different material without fear of contamination by the previous material held in the tank.

BACKGROUND OF THE INVENTION

The washer which is described in this patent application cleans the interior of a tank by spraying continuous streams of a cleaning liquid, usually water, at high pressure against the interior sidewalls of the tank.

This is accomplished by a washer which is relatively inexpensive to manufacture and which can operate for very long periods without requiring maintenance.

SUMMARY OF THE INVENTION

With the foregoing in mind, the invention relates generally to a washer for tanks comprising a housing that includes a liquid inlet is provided. A plurality of nozzles are supported on the housing for reciprocation in an arc about an axis. A piston which is in the housing reciprocates in response to some of the liquid entering the housing along another axis. Means are provided for connecting the piston to the nozzles so that reciprocation of the piston causes the nozzles to reciprocate as the rest of the liquid flows through the nozzles to wash the tank.

In a further aspect of the invention, a piston assembly for use in a housing which is part of a washer for tanks is provided. The piston assembly includes a piston chamber in which a piston is mounted for reciprocation and a connecting rod. The piston head has one end connected to the piston head. The piston is mounted in a washer for reciprocation. The piston head includes a liquid inlet and two liquid outlets. Means are provided in the piston head for directing liquid entering the piston head alternately through the liquid outlets to cause the piston to reciprocates in the piston chamber so that the connecting rod can drive a crankshaft through an arc.

DETAILED DESCRIPTION OF A PRESENTLY PREFERRED FORM OF THE INVENTION

Figure 1:
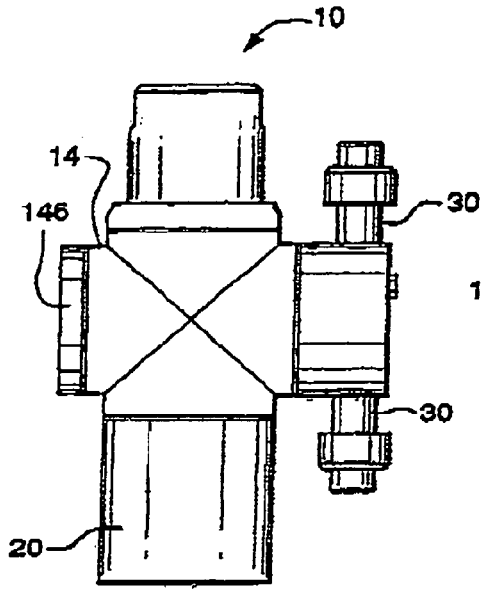
FIG. 1 is a side elevation view of a washer for tanks constructed in accordance with the presently preferred form of the invention.

Now referring to the drawing for a detained description of a presently preferred form of invention, there is seen in FIG. 1 a washer for a tank 10 has a having a housing 14 with a liquid inlet 16, a piston chamber 20 and a nozzle and crankshaft assembly 24 contained substantially inside the housing 14. Externally, the hub 26 of the nozzle and crankshaft assembly 24 and nozzles 30 can be seen.

Figure 2:
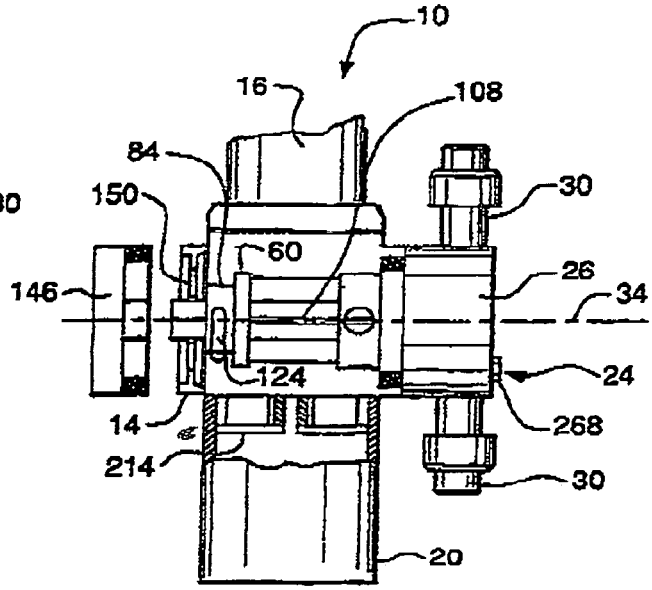
FIG. 2 is a side elevation of the washer for tanks shown in FIG. 1, but with part of its side broken away to show its interior.
Figure 3:
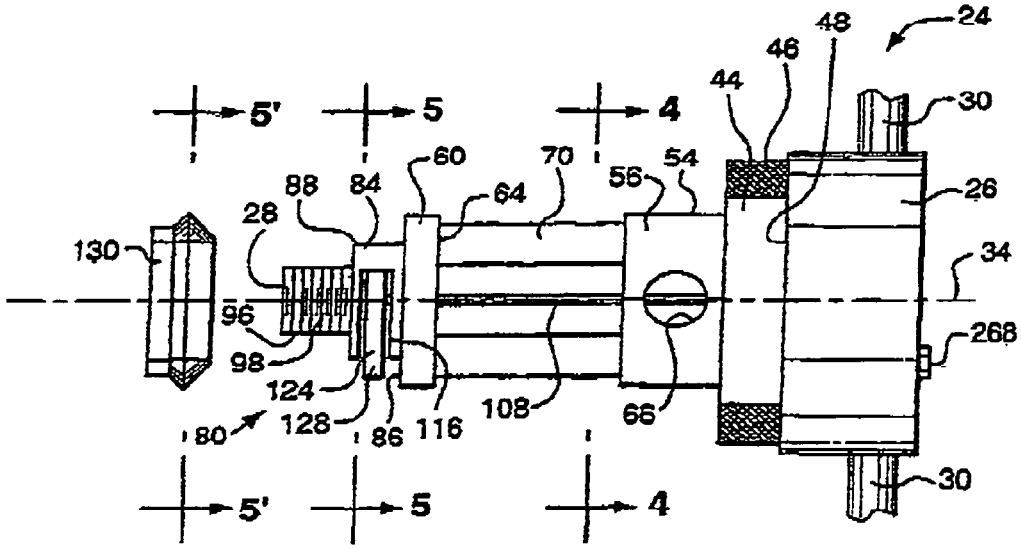
FIG. 3 is a partially exploded side elevation view of the nozzle and crankshaft assembly for the washer for tanks shown in FIG. 1.

Referring to FIGS. 2 and 3, the nozzle and crankshaft assembly 24 is a generally elongated hollow element with an axial opening 28. At one end the nozzle and crankshaft assembly 24 includes the hub 26 of the nozzle assembly which provides a liquid connection between the interior of the housing 14 and the nozzles 30. The nozzle and crankshaft assembly 24 is supported in the housing 14 for rotation about an axis 34.

Immediately adjacent the hub 26 of the nozzle assembly is a nozzle hub support 44 which comprises a hollow section of reduced outer diameter. The nozzle hub support 44 bears against the interior surface of O-ring 46 which is supported in the housing 14 while the inner face 48 of nozzle hub support 44 bears against the end wall of O-ring 46 so that a liquid tight relation is maintained between them.

Immediately adjacent the nozzle hub support 44 is a further hollow section 54 of reduced outer diameter comprising a front portion 56 and a rear portion 60 which are separated by a cut-out 64. The front portion 56 is provided with a plurality of circumferentially space openings 66 (only one of which is shown) to enable liquid which is in the housing 14 to enter the axial opening 26 of the of the nozzle and crankshaft assembly 24.

Figure 4:
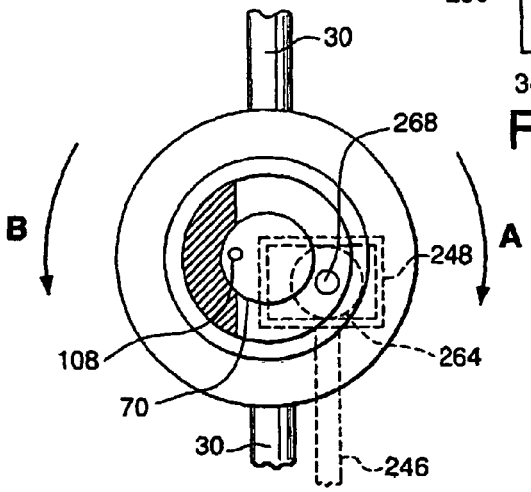
FIG. 4 is a section view taken along line 4-4 of FIG. 3.

As best seen in FIG. 4, the cut-out 64 is of sufficient depth so that it extends substantially entirely through the further hollow section of reduced diameter 54 so that the remnant of the axial opening 26 defines an elongated groove 70.

Immediately adjacent the rear portion 60 of the further hollow section of reduced diameter 54 is a ratchet assembly 80 which will be described in detail herein.

But for now, the ratchet assembly 80 includes a hollow cylindrical section 84 whose axial opening is a part of axial opening 26. The diameter of hollow cylindrical section 84 is slightly less than the diameter of further hollow section of reduced diameter 54 so that its juncture with further hollow section of reduced diameter 54 forms a bearing surface 86 against which a bevel gear, which will be described in detail, bears when the bevel gear is supported on the outer wall 88 of hollow cylindrical section 84. The ratchet assembly 80 is operative to cause the housing 14 to rotate relative to the liquid inlet 16 as will be made apparent.

A hollow cylindrical member 96 with external threads 98 is connected to hollow cylindrical section 84. The opening in hollow cylindrical section 96 is part of the axial opening 26 in the nozzle and crankshaft assembly 24.

Figure 5:
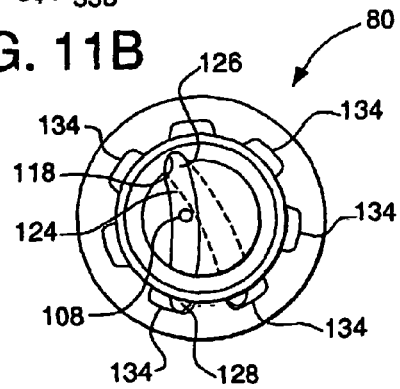
FIG. 5 is a section view taken along lines 5,5'-5,5' of FIG. 3.

As seen in FIGS. 3, 4, and 5, a torsion rod 108 has one end fixed in the end wall 112 of reduced diameter section 54. Preferably, it resides in the elongated groove 70 formed by the cut-out 64.

Referring to the ratchet assembly, 80, the hollow cylindrical section 84 has a slot 116 in its peripheral wall.

As best seen in FIGS. 3 and 5, the interior wall of the hollow cylindrical section 84 includes a longitudinally extending notch 118. A pawl 124 which is an elongated generally arcuate member has one end 126 in engagement with the notch 118 and its other end 128 extending through the slot 116 in hollow cylindrical section 84.

A bevel gear 130, which was mentioned earlier, is shown in FIG. 3 exploded to the left of the of hollow cylindrical section 84 and pawl 124 which support it. As seen in FIG. 5, the interior circumference of the bevel gear 130 is provided with a plurality of teeth 134 which can receive the other end 128 of the pawl 124. Thus, as seen in FIGS. 4 and 5, when the nozzle and crankshaft assembly 24 move clockwise in the direction of arrow "A", the bevel gear 130 remains fixed relative to the housing 14 since the pawl 124 yields under the force of the torsion rod 70 to enable it to slip from tooth to tooth 134 on the interior of the bevel gear 130.

However, when the nozzle and crankshaft assembly 24 move counter-clockwise in the direction of arrow "B" as shown in FIGS. 4 and 5, the pawl 124 engages the teeth 134 on the interior surface of the bevel gear 130 and causes the bevel gear 130 to rotate with it.

The bevel gear 130 is an important part of the mechanism for enabling the washer 10 to pivot about an axis that is in alignment with the liquid inlet to the housing 14 in a series of discrete steps as will be more fully explained.

As seen in FIG. 2, the rear wall of the bevel gear 130 (removes for the sake of clarity of the drawing) bears against a collar 150 on the interior of the housing 14 to restrain it against rearward axial movement on the reduced diameter section 54. Thus, as earlier explained, forward axial movement of the bevel gear 130 is restrained by bearing surface 86.

The nozzle and crankshaft assembly 24 is held in the housing 14 by an end cap 146 (FIG. 2) which threadingly engages the aforementioned external threads 98 on hollow cylindrical member 96 and which bears against an O-ring which is seated in the housing 14.

Figure 6:
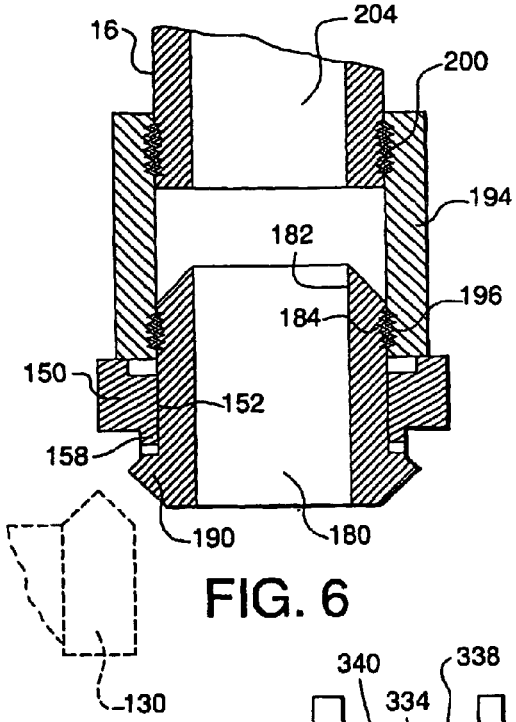
FIG. 6 is a side elevation view, partially in section of a portion of the washer for tanks shown in FIG. 1.

The liquid inlet 16 can best be seen in FIGS. 2 and 6. It comprises, in part, a collar 150 with a smooth interior wall which defines a bearing surface 152. The collar 150 has a reduced diameter lower section 158 which has external threads to engage complimentary internal threads on an internal collar 166 in the upper portion of the housing 14. Suitable O-rings are provided to reduce the likelihood of liquid leakage between the parts.

Contained within the smooth interior wall and in engagement with the bearing surface 152 in collar 150 is an elongated hollow sleeve 180 which has an upper portion 182 which extends above the collar 150 and which has external threads 184. Its lower portion 190 includes a bevel gear 190 which is in driven relationship with earlier mentioned bevel gear 130 which is seen best in FIGS. 3 and 6.

A second collar 194 has at its lower end internal threads 196 which are complementary to and engage external threads 182. At its upper end, collar 194 has internal threads 200 which can be connected to complementary threads on a liquid supply pipe 204.

It should be noted that elongated hollow sleeve 180 and bevel gear 190 along with collar 194 are fixed to the liquid supply pipe 204. Accordingly, they are incapable of movement. However, the collar 150 is free to rotate about an axis defined by the liquid supply pipe 204.

As explained earlier, the housing 14 is connected to the collar 150. Accordingly, both the collar 150 and the housing 14 can rotate together about the liquid supply pipe 204.

The manner in which this rotation is accomplished will now be described.

Figure 7:
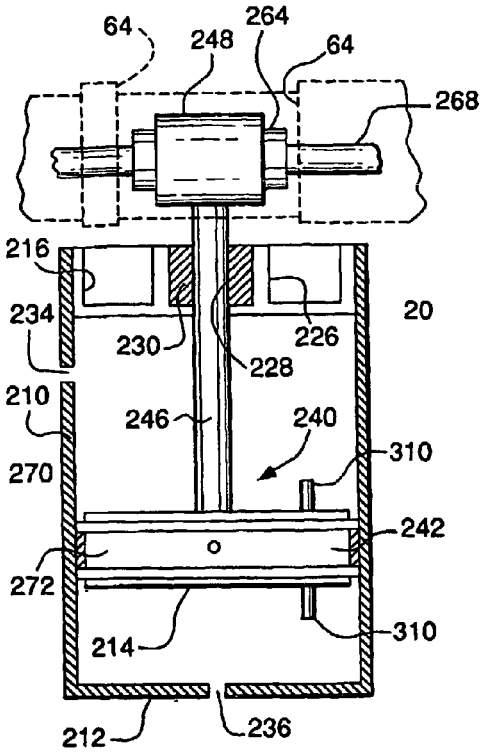
FIG. 7 is a side elevation view, partially in section, of the interior of the piston chamber of the washer for tanks shown in FIG. 1.

As best seen in FIGS. 2 and 7, the piston chamber 20 may be generally cylindrical. It includes a side wall 210 and a bottom wall 212. Its top wall 214 is defined by the bottom wall of a cylindrical member 216 extending downwardly from the lower part of housing 14 and which has external threads.

As seen in FIGS. 2 and 7, the piston chamber 20 includes internal threads that engage the external threads on the cylindrical member 216 to connect the piston chamber 20 to the housing 14. The top wall 214 includes an upwardly extending collar 226 having a central opening 228 surrounded by a bushing 230.

A first drain opening 234 is provided in the upper portion of the sidewall 210. A second drain opening 236 is provided in the bottom wall 212.

Figure 8A:
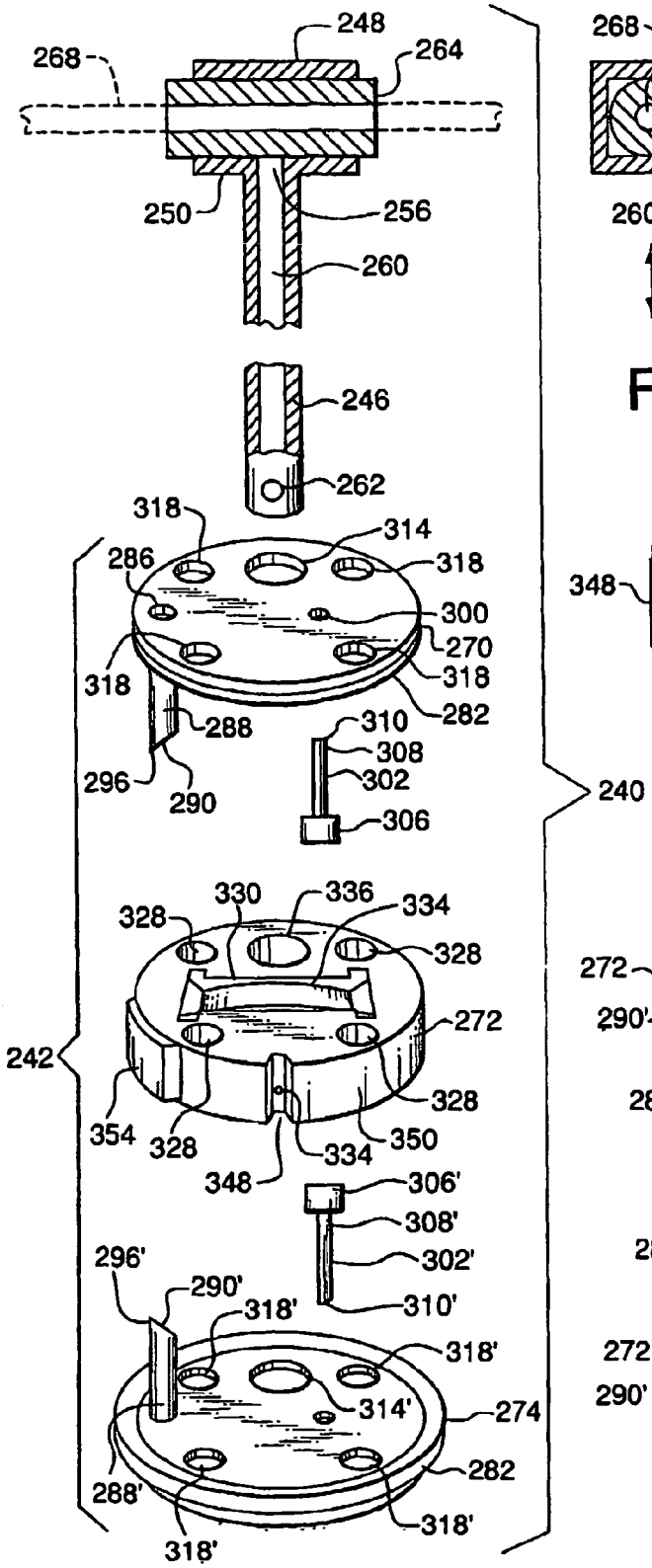
FIGS. 8A and 8B are an exploded perspective view, partially in section of the piston head and connecting rod contained within the piston chamber shown in FIG. 7.
Figure 8B:
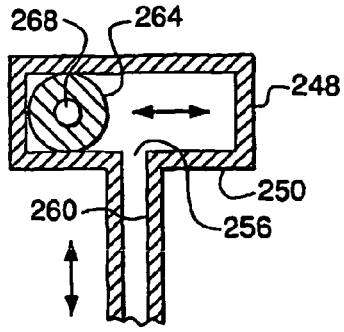

As best seen in FIGS. 7, 8A and 8B, the piston 240 includes a piston head 242 to which is connected an upwardly extending connecting rod 246 which extends through central opening 228.

The upwardly extending connecting rod 246 includes an open sided rectangular cage 248 at its upper end. The bottom wall 250 of the cage 248 includes an opening 256 which connects to an elongated conduit 260 which extends downwardly through the connecting rod 246.

The lower end of the connecting rod 246 terminates inside the piston head 242. The lower end of the connecting rod 246 includes a laterally directed opening 262 which is in liquid connection with the aforementioned elongated conduit 260.

A guide roller 264 which may a generally hollow cylindrical member is contained within the cage 248 so that it can reciprocate from one end of the cage 248 to the other as seen in FIG. 8B.

As seen in FIG. 7, the rectangular cage 248 and guide roller 264 are received in and are retained in the cut-out 64 by an elongated pin 268 which extends through an opening in the hub 26 of the nozzle assembly and extends into a blind hole (not shown) in the rear portion 60 of hollow section 54. The elongated pin 268 is spaced radially from the axis of rotation of the nozzle and crankshaft 24.

The length of roller 264 is slightly less than the length of cut-out 64 (FIGS. 2 and 3). Thus, the guide roller 264 is constrained in the cut-out 64 so that it can only move back and forth in the rectangular cage 248.

As seen in FIGS. 7 and 8A, the piston head 242 includes an upper end cap 270, a mid-portion 272 and a lower end cap 274.

The upper end cap 270 comprises a relatively flat disc, having a downwardly facing peripheral notch in which is received an O-ring seal 282.

The upper end cap 270 includes a first opening 286 which lies along one of its diameters but spaced from its center. From the first opening 286 there is connected a downwardly extending conduit 288 having a beveled end 290 with its inner juncture with the conduit 288 being closer to the upper end cap 270 than its outer edge 296.

On generally the same diameter, but on the other side of the center of the upper end cap 270 is another opening 300. A pin 302 having a head 306 whose diameter is greater than the opening 300 and which includes an upwardly extending shaft 308 having a diameter less that the opening 300 is provided. The pin 302 is positioned in the opening with the head 304 against the underside of the upper end cap 270 and its shaft 308 extending through the opening 300 so that its distal end 310 is exposed. Thus, when a downward force is applied to the distal end 310 the pin 302 will move downwardly through opening 300.

An opening 314 is provided near the periphery of the upper end cap 270 through which the lower end of the connecting rod 246 is received.

Openings 318 are provided in the upper end cap 270 to receive suitable screws for connecting the upper end cap to mid-portion 272.

The lower end cap 274 is a mirror image of the upper end cap 270. Thus, it need not be described further other than to say that its parts are identified by the same numerals as those associated with the upper end cap 270 except that they are followed by a "'".

Thus, end caps 270 and 270' and seals 282 and 282' provide a sealing relation between the piston head 242 and the walls of the piston chamber 20.

However, it should be noted that pins 308 and 308' are opposite each other, and conduits 288 and 288' and their respective beveled ends 290 and 290' are opposite each other.

The mid-portion 272 of the piston head 242 includes a diametrically extending elongated relatively wide opening 330. A flat blade 334, preferably made of a thin rust resistant metal 334 is slightly longer than the opening 330 has its ends wedged into notches at the ends of opening 330 so that it is slightly bowed.

Figure 10A:
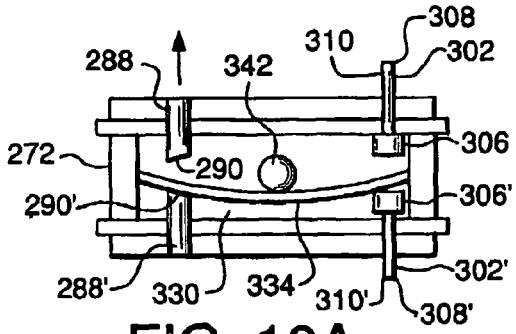
FIG. 10A is a view partially in section of the configuration of the piston head when it is moving up within the piston chamber.
Figure 10B:
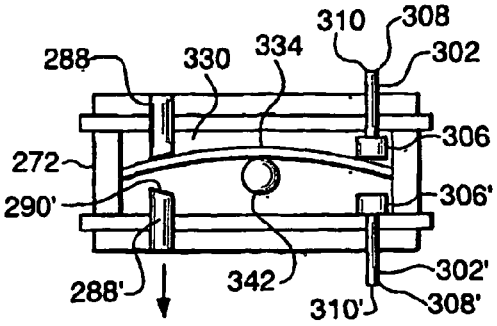
FIG. 10B is a view partially in section of the configuration of the piston head when it is moving down within the piston chamber.

In FIG. 10A the blade 334 is shown bowed upwardly to create a "frown." However, upon the application of force, it can be pushed until it snaps into a downwardly bowed position where it achieves a "smile" as seen in FIG. 10B.

The mid-portion 272 includes an opening 336 which can be aligned with openings 314 in the upper end cap 270 and opening 214' in the lower end cap 274 when the piston head 240 is assembled such as when screws passing through 318 and 318' are connected to internally threaded openings 328 in the mid-portion 272.

Figure 9:
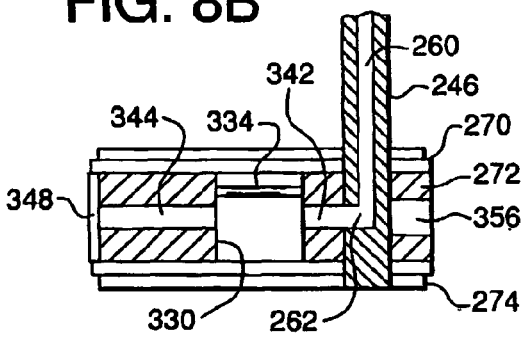
FIG. 9 is a section view taken along line 9-9 of FIG. 8A.

As best seen in FIGS. 8A and 9, the connecting rod 246 is received in openings 314, 336 and 314' in the piston head 242 so that laterally extending opening 262 in the lower end of the connecting rod 246 is aligned with conduit 342 in the mid-portion 272 to permit liquid flowing through laterally extending opening 262 to enter the opening 330 in the mid-portion 272. The connecting rod 246 is retained in position by a suitable set screw (not shown) which is threadingly received in opening 356.

The opening 336 is also connected by another conduit 344 to a recess 348 formed in the circumferential wall 350 of the mid-portion 272. A gasket 354 (shown in section) extends around the circumferential wall 350 of the mid-portion 272 to provide further sealing between the piston head 240 and the piston chamber 20.

In operation the washer 10 is connected to liquid supply pipe 204 by being threadingly connected to collar 194. Collar 194 is connected to elongated hollow sleeve 180 and its bevel gear 190 so that the collar 194, hollow sleeve 180 and bevel gear 190 are constrained against movement by the liquid supply pipe 204.

A suitable liquid such as a cleaning solution or the like enters the washer 10 through the supply pipe 204 and liquid inlet 16 filling the housing 14. In the washer 10 the liquid is divided into two liquid paths. One path includes the axial opening 26 in the nozzle and crankshaft assembly 24 which directs the liquid to the hub 26 of the nozzle assembly and then out the nozzles 30 to be sprayed onto the surface to be cleaned.

The second liquid path directs about one percent of the liquid entering the washer 10 into the piston chamber 20. The second liquid path includes the opening 256 at the bottom of rectangular cage 248, elongated conduit 260 in connecting rod 246, laterally extending opening 262 at the bottom of connecting rod 246 and conduit 342 in the mid-portion 272 of the piston head 240 and into opening 330.

Liquid initially received in opening 330 is directed to either one side or the other of the piston head 242, depending on the position of the blade 334, to drive the piston in the opposite direction in a manner which will now be described.

As best seen in FIGS. 10A and 10B, the liquid will encounter the blade 334 bowed either up ("frown") or down ("smile"). If it is bowed down (FIG. 10B), then it closes conduit 288' because it bears against the beveled end 290' at the upper end of the conduit 288'. The bevel of the end 290' is at the same angle the curvature of the blade 334 makes at their point of contact.

Consequently, liquid entering the mid-portion 272 of the piston head 242 through the elongated conduit 260 in the connecting rod 246 and conduit 342 will enter conduit 288 at its beveled end 290 and flow through conduit 288 into the space between the piston head 242 and the top wall 214 of the piston chamber 20. This causes the piston 240 to move downward. If there is liquid in the space between the piston head 240 and bottom wall 212 of the piston chamber 20 it simply leaks out through drain opening 236 in the bottom wall 212.

As seen in FIG. 10A, when the piston head 240 nears the bottom wall 212 of the piston chamber 20, the distal end 310' of the shaft 308' of pin 302' strikes the bottom wall 212 of the piston chamber 20. This presses the pin head 306' into engagement with the blade 334. It pushes and bends the blade 334, as will be described, so that it moves to the position shown in FIG. 10B.

Figure 11A:
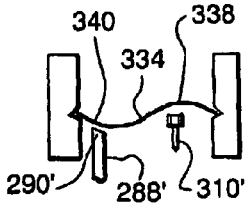
FIG. 11A is a schematic view of the forces applied to a part of the invention which enable the piston head to change its direction of movement.

Since the pin 302' is located to the side of the blade 334, it initially forces the part 338 of the blade 334 against which is presses to move so that the blade 334, which is slightly longer than opening assumes the configuration of an "S" as seen in FIG. 11A. The force which the pin 302' applies to the blade 334 is stored in the "S" configuration as energy.

Because the blade 334 is resilient, some of the stored energy is released by forcing the rest 340 of the blade 334 into closer relation to the beveled end 290' thereby further assuring that there is no liquid flow through it.

Continued movement of the pin 302' will force the blade 334 over its center of resistance. This releases the remainder of the energy stored in the blade 334 so that the blade 334 now moves independently of the pin and snaps away from beveled end 290' to the position shown in FIG. 10B where it now closes beveled end 290 on conduit 288. Pin 302 which is freely moveable in opening 300 offers no resistance to the blade 334 as it moves to the position shown in FIG. 10B.

With the blade 334 in the position shown in FIG. 10B, the beveled end 290 of downwardly extending conduit 288 is closed and the opening 290' in upwardly extending conduit 288' is open. Thus, liquid entering mid-portion 272 of piston head 242 through conduit 342 flows through conduit 288' into the space between the bottom wall 212 and the piston head 242. This drives the piston head 242 upwardly toward top wall 214. Liquid trapped in the space between the top wall 214 and the piston head 242 is permitted to leak from the piston chamber 20 through drain opening 234.

Figure 11B:
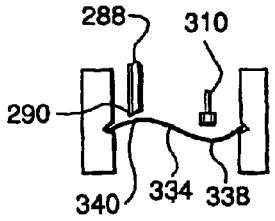
FIG. 11B is a schematic view of the forces applied to the part of the invention shown in FIG. 11A which enable the piston head to change its direction of movement from that shown in FIG. 11A.

When the piston head 242 nears the top wall 214 of the piston chamber 20, the distal end 310 of the shaft 308 of upwardly extending pin 302 will strike the top wall 214. This causes pin 302 to engage the blade 334 at 340 and apply force to it as seen in FIG. 11B until it snaps to the position shown in FIG. 10B. This closes conduit 288' and opens conduit 288 to cause the piston head 242 to move toward bottom wall 212.

Thus, the relationship of the pins 302, 302', conduits 288, 288', and blade 334 and drain openings 234 and 236 form a mechanism which enables the piston 240 to reciprocate within the piston chamber 20.

Since the connecting rod shaft 246, rectangular cage 248 and guide roller 264 are all connected to the piston 240, they reciprocate also.

As explained earlier, the rectangular cage 248 and guide roller 264 are connected to the nozzle and crankshaft assembly 24 by elongated pin 268 (FIG. 7). The elongated pin 268 is spaced radially from the axis of rotation of the nozzle and crankshaft 24. Thus, as the piston 240 reciprocates in the piston chamber 20, it causes the nozzle and crankshaft assembly to move about its axis of rotation in a well known manner. The range of movement of the nozzle and crankshaft assembly is limited so that it can only pivot through an arc of slightly greater than 90° when the hub 26 of the nozzle assembly 28 supports two nozzles 30 as shown in FIGS. 1 and 2. If the hub of the nozzle assembly supports three nozzles, the range of arcuate movement can be reduced to about slightly greater than 60°. The guide roller 264 moves move back and forth in the rectangular cage 248 as the nozzle and crankshaft assembly rotates to maintain its driving connection with them.

The range of movement of the nozzle and crankshaft assembly 24 is limited by the range of movement of the piston head 240 and the length of the connecting rod 246.

As is apparent, the range of movement of the piston head 240 is limited by the distance between the upper and lower walls 212 and 214 of the piston chamber 20 and/or the length of the pins 302 and 302'. Thus, if the pins are longer, the reversal of movement of the piston head 240 occurs sooner.

The arc of reciprocation is further controlled by limiting the length of the connecting rod 246 to a distance that is less than the distance between the upper limit of piston 240 movement and the upper part of cut-out 64.

Thus, at the preferred arc of reciprocation, thorough cleaning occurs without the connecting rod 246 striking the cut-out 50 thereby avoiding metal-to-metal contact.

Further, the speed at which the reciprocation of the piston occurs can be controlled by changing the size of the drain openings 234 and 236. Thus larger opening permit the liquid to leave the piston chamber 20 faster to increase the speed of the piston.

When two nozzles 30 are used, they reciprocate through an arc of slightly more than 90°. When three nozzles are used, they reciprocate through an arc of slightly more than 60°. However, these arcs are not critical and the cleaner will work equally as well to clean tanks if the arcs were somewhat smaller or somewhat larger.

Thus, as is apparent and by way of summary, piston 240, connecting rod shaft 246, open sided rectangular cage 248, guide roller 264, pin 268 (FIG. 7), nozzle and crank shaft assembly 24 comprise a means for connecting the piston 240 to nozzles 30 so that when the piston 240 reciprocates, the nozzles also reciprocate.

The washer 10 is driven about the liquid supply pipe 204 by the reciprocation of the nozzle and crankshaft assembly 24. As seen in FIG. 6, the elongated hollow sleeve 180 and bevel gear 190 are fixed to the liquid supply pipe 204 and thus can not rotate. Since the bevel gear 130 in engagement with bevel gear 190, it also can not rotate.

As explained earlier, the nozzle and crankshaft assembly 24 supports bevel gear 130. The nozzle and crankshaft assembly 24 is limited for movement in one direction relative to the bevel gear 130 by the ratchet assembly 80.

Thus, as seen in FIGS. 5 and 6, when the nozzle and crankshaft assembly 24 rotates in the direction A (FIG. 4) under the force of the piston 240 reciprocating in piston chamber 20, the pawl 124 yields to permit the rotation.

However, when the nozzle and crankshaft assembly 24 moves in the direction of arrow B (FIG. 4) under the force of the piston 240 reciprocating in piston chamber 20, the pawl 124 prevents relative rotation between the nozzle and crankshaft assembly 24 and the bevel gear 130.

Therefore, the bevel gear 130 is required to rotate around bevel gear 190 and the supply pips 204 in a series of "steps." The number of steps necessary to rotate the housing 14 and nozzles 30 around the supply pipe 204 to wash the interior of a tank can be varied in accordance with the number of teeth on each of the bevel gears 130 and 190 and the number of teeth 134 in the interior circumference of the bevel gear 130.

Thus, by way of summary, the piston 240 reciprocates inside piston chamber 20 under the force of the liquid entering the washer 10. The reciprocation of the piston causes the nozzle and crankshaft assembly 24 to reciprocate through about 90° as liquid is sprayed the nozzle 30.

The reciprocation of the nozzle and crankshaft assembly 24 causes the bevel gear 130 to move around the bevel gear 190 to cause the housing 14 to rotate around the liquid supply conduit 204 in a plurality of steps to wash the interior of the tank that is being cleaned.

While the invention has been described with regard to one presently preferred form, it is apparent that other forms of embodiments will be obvious skilled in the art in view of the foregoing description.

Accordingly, the scope of the invention should not be limited by the foregoing description, but rather, only by the scope of the appended claims.

The invention claimed is:

1. A tank washer comprising a housing, first and second axes, a plurality of nozzles, said nozzles being supported on said housing for reciprocation around one of said axes, a piston in said housing, said piston being reciprocal along said other axis, and means for connecting said piston to said nozzles so that reciprocation of said piston causes said nozzles to reciprocate.

2. A tank washer as defined in claim 1 including a first chamber in said housing, said piston being disposed in first chamber for reciprocal movement, a second chamber, and said nozzles being in liquid connection with said second chamber so that said second chamber and said nozzles define a liquid conduit.

3. A tank washer as defined in claim 2 wherein said nozzles are supported by an elongated hollow element that is supported for reciprocation in said housing, said elongated hollow element including a central opening that is in liquid connection with said nozzles, and said hollow member includes means for enabling it to be connected to said piston so that movement of said piston causes said elongated member and said nozzles to reciprocate.

4. A tank washer as defined in claim 2 including a liquid inlet conduit connected to said housing for supplying liquid to said housing, means for enabling said housing to rotate relative to said to said liquid inlet conduit, and mutually engagable means supported by said liquid inlet conduit and said hollow member for causing said housing to rotate relative to said liquid inlet conduit as said piston reciprocates.

5. A tank washer as defined in claim 4 wherein said mutually engagable means comprising a first gear supported on said hollow member, means connected between said first gear and said hollow member for permitting said gear to rotate relative to said hollow member in one direction, and to be driven by said hollow member in a second direction.

6. A tank washer as defined in claim 5 wherein said mutually engagable means further comprising a second gear, said second gear being fixed to said liquid inlet conduit so that when said first gear drives said second gear, said housing rotates around said liquid inlet conduit.

7. A tank washer as defined in claim 5 wherein said means connected between said first gear and said hollow member for permitting said gear to rotate relative to said hollow member in one direction, and to be driven by said hollow member in a second direction comprises a pawl recess on the interior wall of said hollow member, an opening in said wall of said hollow member generally opposite to pawl recess, a pawl, one part of said pawl being received in said pawl recess and another part of said pawl extending through said opening in said wall, and means connected between hollow member and said pawl for urging said other part of said pawl into engagement with said first gear.

8. A tank washer as defined in claim 7 wherein said means connected between hollow member and said pawl for urging said other part of said pawl into engagement with said first gear comprises an elongated torsion member, one end of said elongated torsion member being connected to said hollow member, and the other end of said elongated torsion member being connected to said pawl.

9. A tank washer as defined in claim 1 wherein said housing includes a piston chamber, said piston including a piston head and a connecting rod having one end connected to said piston head, said piston being mounted in said piston chamber for reciprocation, and means for providing a sealing relation between said piston head and the walls of said piston chamber.

10. A tank washer as defined in claim 9 wherein said piston head includes a liquid inlet and two liquid outlets, and means for directing liquid entering said piston head through said piston head alternately through said liquid outlets to cause said piston to reciprocate in said piston chamber.

11. A tank washer as defined in claim 10 wherein each of said liquid outlets is on a different side of said piston head.

12. A tank washer as defined in claim 10 wherein said means for directing liquid comprises a means for closing said liquid outlets in said piston head, said means for closing said liquid outlets is operative to selectively close said liquid outlets so that when one of said liquid outlets is closed the other liquid outlet is open.

13. A tank washer as defined in claim 10 wherein said piston head includes a mid-portion and upper and lower end caps, said mid-portion including a central opening, said central opening being in liquid communication with both of said liquid outlets, each of said liquid outlets being in one of said piston end caps, and means in said central opening for selectively closing said liquid outlets so that when one of said liquid outlets is closed the other liquid outlet is open.

14. A tank washer as defined in claim 13 wherein said means for selectively closing said liquid outlets comprises a resilient flexible member supported in said central opening in said mid-portion, said resilient flexible member being movable between a first position where one of said liquid outlets is closed and a second position where the other liquid outlet is closed.

15. A tank washer as defined in claim 14 including means for moving said resilient flexible member toward one of said positions from the other position, said last named means being operative to store energy in said resilient flexible member as said last named means moves toward said other position, said means for moving said resilient flexible member comprising pins extending through said end caps and being mutually engagable with the end walls of said piston chamber and said resilient flexible member so that as said piston reciprocates in said piston chamber said pins alternately engage the end walls of said piston chamber and said resilient flexible member to increase the energy stored in said resilient flexible member as a portion of said resilient flexible member moves toward said other position while the rest of said resilient flexible member maintains said one of said liquid outlet closed, and the release of said stored energy moves said resilient flexible member away from said means for moving said resilient flexible member to said other position where said one of said liquid outlets is open and the other of said liquid outlets is closed.

* * * * *